US011073119B2

(12) United States Patent
Diaferia et al.

(10) Patent No.: US 11,073,119 B2
(45) Date of Patent: Jul. 27, 2021

(54) METERING VALVE FOR A PUMP UNIT FOR FEEDING FUEL TO INTERNAL COMBUSTION ENGINE AND PUMP UNIT COMPRISING SUCH A VALVE

(71) Applicant: Robert Bosch GmbH, Stuttgart (DE)

(72) Inventors: Antonio Diaferia, Bari (IT); Jochen Aleker, Hallein (AT); Mauro De Bellis, Brindisi (IT); Nello Medoro, Trinitapoli (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/756,653

(22) PCT Filed: Oct. 12, 2018

(86) PCT No.: PCT/EP2018/077875

§ 371 (c)(1),
(2) Date: Apr. 16, 2020

(87) PCT Pub. No.: WO2019/076753

PCT Pub. Date: Apr. 25, 2019

(65) Prior Publication Data

US 2020/0332752 A1 Oct. 22, 2020

(30) Foreign Application Priority Data

Oct. 16, 2017 (IT) ..... 102017000116427

(51) Int. Cl.
*F02M 59/34* (2006.01)
*F02M 59/46* (2006.01)
*F02M 63/00* (2006.01)

(52) U.S. Cl.
CPC ..... *F02M 59/34* (2013.01); *F02M 59/466* (2013.01); *F02M 63/004* (2013.01);
(Continued)

(58) Field of Classification Search
CPC .. F02M 59/34; F02M 59/466; F02M 63/0017; F02M 63/004; F02M 63/0056; F02M 63/0078
(Continued)

(56) References Cited

U.S. PATENT DOCUMENTS 5,918,635 A * 7/1999 Wang ..... F16K 31/0693 137/625.65
6,345,608 B1 * 2/2002 Rembold ..... F02M 59/34 123/506
(Continued)

FOREIGN PATENT DOCUMENTS

| | | |
|---|---|---|
| DE | 102012211394 | 1/2014 |
| EP | 1674717 | 6/2006 |
| JP | 2016223448 | 12/2016 |

OTHER PUBLICATIONS

International Search Report for Application No. PCT/EP2018/077875 dated Nov. 19, 2018 (2 pages).

*Primary Examiner* — Mahmoud Gimie
(74) *Attorney, Agent, or Firm* — Michael Best & Friedrich LLP

(57) ABSTRACT

A metering valve for a pump unit for feeding fuel from a tank to an internal combustion engine; the metering valve having: a sleeve having an axis A and provided with a first open end for receiving a thruster, a second opposite end provided with an opening for axially discharging the fuel and at least one side opening for feeding fuel; a plug-shaped piston housed slidably along the axis A inside the sleeve, the piston being provided with a closed end having an outer surface in contact with the thruster, an open opposite end and at least one side opening; a plug housed inside the discharge opening of the sleeve and provided with an axial opening; a spring arranged between the plug and the inner surface of the closed end of the sleeve.

10 Claims, 2 Drawing Sheets

(52) U.S. Cl.
CPC .... *F02M 63/0017* (2013.01); *F02M 63/0056* (2013.01); *F02M 63/0078* (2013.01)

(58) Field of Classification Search
USPC ..... 123/446
See application file for complete search history.

(56) References Cited

U.S. PATENT DOCUMENTS

| | | | | |
|---|---|---|---|---|
| 6,959,907 | B2 * | 11/2005 | Hironaka | B60T 8/363 251/129.07 |
| 7,040,594 | B2 * | 5/2006 | Hironaka | B60T 8/363 251/129.07 |
| 2003/0089872 | A1 | 5/2003 | Furuta et al. | |
| 2004/0223856 | A1 * | 11/2004 | Rembold | F02M 63/0015 417/222.2 |
| 2006/0065870 | A1 * | 3/2006 | Mori | F02M 63/0225 251/129.07 |
| 2006/0222518 | A1 * | 10/2006 | Oda | F02M 59/366 417/298 |

* cited by examiner

METERING VALVE FOR A PUMP UNIT FOR FEEDING FUEL TO INTERNAL COMBUSTION ENGINE AND PUMP UNIT COMPRISING SUCH A VALVE

BACKGROUND OF THE INVENTION

The present invention relates to a metering valve for a pump unit for feeding fuel, preferably diesel fuel, to an internal combustion engine. The present invention also relates to a pump unit for feeding fuel, preferably diesel fuel, to an internal combustion engine in which this pump unit comprises the aforementioned metering valve.

As is known, a pump unit for feeding fuel, preferably diesel fuel, to an internal combustion engine comprises a head which has, formed therein, at least one cylinder housing an associated sliding pumping piston. One end of the pumping piston, in particular the inner end with respect to the pump unit, known as the base of the piston, is connected to an actuator, usually a cam shaft, which by rotating actuates the movement of the piston. A special spring for keeping the shaft pressed against the cam shaft is provided. Moving along the cylinder with a reciprocating motion, the piston performs an intake stroke, during which it moves downwards towards the axis of the cam shaft and draws fuel into the cylinder, and a compression stroke during which it moves away from the axis of the cam shaft and compresses the fuel retained inside the cylinder. The cylinder portion where compression is performed is called the compression chamber inside which the end of the piston known as piston head acts. Generally, the feeding of fuel into cylinder occurs through an intake hole, while discharging of the compressed fuel occurs along a delivery duct. The outer part of the head for collecting the fuel which must be fed to the cylinder is called the intake chamber. This chamber is fed by a duct called intake duct and is closed externally by a suitable plug sealingly fastened against the head. On the outside of the head, the delivery duct is connected to the engine, preferably by means of a common header from which a plurality of injectors extend. Suitable valves are provided for regulating the correct flow of the fuel from the intake chamber to the cylinder and from the cylinder to the external header.

The intake chamber is connected to the cylinder by means of a valve called intake valve, usually in the form of a stem-like closing member housed inside a guide hole formed in the head axial to the axis A of the cylinder. This closing member has a first end inside the cylinder, in the region of the compression chamber, and a second end at the head. The intake valve selectively places the intake chamber in communication with the compression chamber in order to feed into the cylinder the fuel drawn from the tank by means of a low-pressure pump, usually a gear pump.

It is known to provide a throttle or metering valve, downstream of the low-pressure pump in order to control the pressure and the flowrate inside the intake duct. The metering valve is preferably an electric valve, with at least one inlet side which communicates with the delivery of the low-pressure pump and at least one outlet side which communicates with the intake duct for feeding the intake chamber. The metering valve comprises an electromagnetic head configured to control the upward and downward movement of a push-piece or thruster which presses against a spring-loaded piston. Said piston is plug-shaped, namely cylindrical, with a closed end and an open opposite end, and is housed inside a fixed sleeve provided with openings connected to the fuel delivery point. The sleeve is in the form of a cylinder with a substantially circular cross-section and is open at both the ends so as to allow on the hand the passing movement of the thruster and on the other hand discharging of the fuel crossing the piston. The movable piston comprises side windows which, during the piston stroke, are selectively arranged opposite the openings in the sleeve. In these conditions the fuel first passes beyond the openings in the sleeve and the windows in the piston and is then discharged via the bottom opening of the piston. The particular profile of the piston windows, which are for example triangular in shape, ensures that the fuel flow passing during the movement of the piston with respect to the fixed sleeve is proportional. As mentioned above, the piston is spring-loaded so as to press against the thruster which is electromagnetically operated. This spring comprises a first end housed inside the piston bearing against the inner surface of the closed end and a second end bearing against a retaining plug fixed inside the sleeve in a position facing the open end of the piston. This retaining plug comprises a surface inside the sleeve provided with a step for seating the spring and an outer side surface for engagement along the whole of its periphery with the inner surface of the sleeve. In order to allow discharging of the fuel, the retaining plug comprises a through-hole centred in the axis of the sleeve and extending radially substantially as far as the spring itself.

Today there exists the need to increase the hourly flow of fuel passing through these valves without, however, increasing the design costs and losing the possibility of standardization of the components which could result from complete redesigning of the valve. Merely increasing the discharge radius of the retaining plug obviously is not possible, without a reduction in the contact area of the spring.

SUMMARY OF THE INVENTION

Based on this known technology, an object of the present invention is to provide a metering valve able to increase the hourly flow of fuel passing inside these valves without increasing the design cost and without losing the possibility of standardization of the components.

In accordance with the present invention a metering valve for a pump unit for feeding fuel from a tank to an internal-combustion engine is provided. This metering valve comprises:

a sleeve having an axis A and provided with a first open end for receiving a thruster, a second opposite end provided with an opening for axially discharging the fuel, and at least one side opening for feeding fuel;

a plug-shaped piston slidably housed along the axis A inside the sleeve, the piston having a closed end with an outer surface in contact with the thruster, an open opposite end and at least one side opening;

a plug housed inside the discharge opening of the sleeve and provided with an axial opening;

a spring arranged between the plug and the inner surface of the closed end of the sleeve.

According to the main feature of the invention, the plug is shaped so that, when it is housed inside the axial discharge opening, there is at least one lateral flow channel for discharging fuel between the axial discharge opening of the sleeve and the side surface of the plug.

Advantageously, in this way, for the same axial opening of the plug and axial discharge opening of the sleeve, the overall aperture for discharging fuel from the metering valve is increased.

Preferably, the plug is shaped so that, when it is housed inside the axial discharge opening of the sleeve, it forms a plurality of lateral flow channels for discharging fuel, these lateral flow channels being arranged in an axially symmetrical manner with respect to the axis A.

Advantageously, in this way the load of the spring is transmitted to the plug in a uniform manner around the axis A.

Preferably, the plug comprises an inner face provided with an axial step for seating the spring. In this configuration, the plug comprises a side wall having at least one portion for contact with the axial discharge opening of the sleeve and at least one inset portion having a radius R2 from the axis A smaller than the radius R1 of the contact portion. The radius R2 of the inset portion coincides with the outer radius of the axial step against which the spring rests.

The invention has been described above with reference to a metering valve. However, the present invention is also applicable to the pump unit which comprises this valve as well as to the single retaining plug which, when installed in working pumps, allows the predefined objects of the present invention to be achieved.

BRIEF DESCRIPTION OF THE DRAWINGS

Further characteristic features and advantages of the present invention will become clear from the description below of a non-limiting example of embodiment thereof, with reference to the figures of the attached drawings, in which.

DETAILED DESCRIPTION

Figure 1:
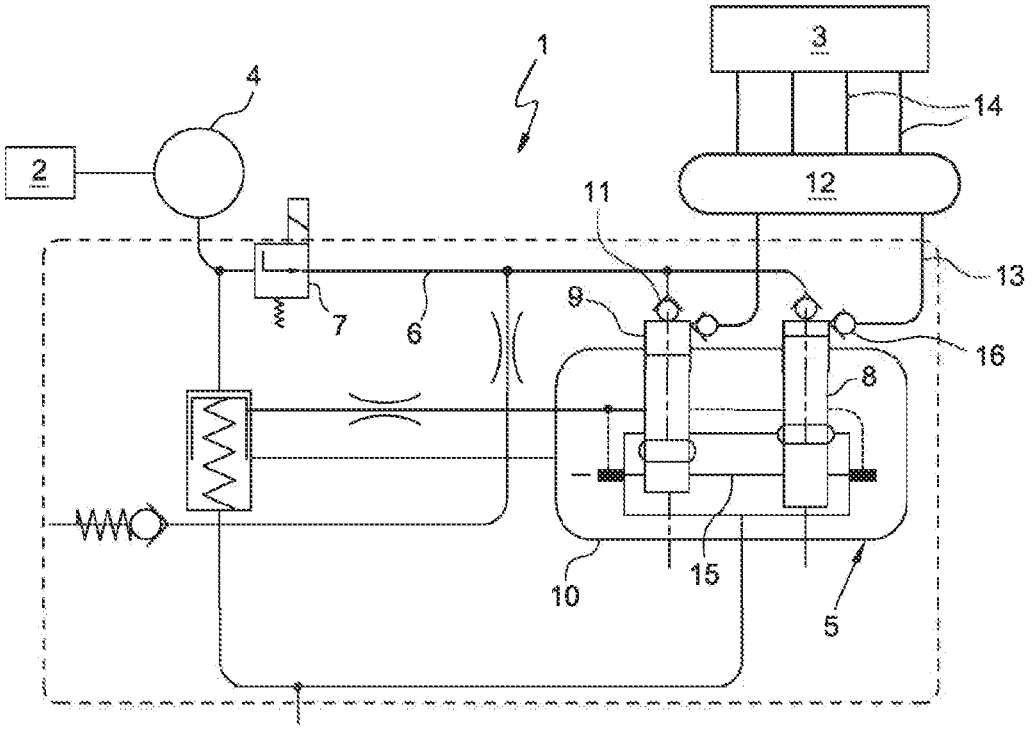
FIG. 1 is a view showing a hydraulic diagram of a pump unit for feeding fuel, preferably diesel fuel, from a tank to an internal combustion engine, in which a low-pressure pump and a high-pressure pump are arranged in series.

FIG. 1 is a schematic view of an example of a pump unit for feeding fuel, preferably diesel fuel, from a tank to an internal combustion engine, in which a low-pressure pump and a high-pressure pump are arranged in series. In particular, FIG. 1 shows a pump unit 1 comprising:

a low-pressure pump 4 for drawing fuel from a tank 2;

a high-pressure pump 5 fed by the low-pressure pump 4;

an intake duct 6 for feeding the fuel from the low-pressure pump 4 to the high-pressure pump 5;

high-pressure delivery ducts 13 for feeding the fuel from the high-pressure pump 5 to the internal combustion engine 3.

In this example the internal combustion engine 3 is shown only in schematic form and comprising a common header 12 fed by the high-pressure delivery ducts 13 and a plurality of injectors 14 configured to atomize and inject the high-pressure fuel into the cylinders of the internal combustion engine 3 (not shown). In FIG. 1 the high-pressure pump 5 is shown only in schematic form and comprises two pumping pistons 8 housed inside associated cylinders 9 formed in a head 10 and fed with the low-pressure fuel at feed valves 11. The cylinders 9 are in turn connected to delivery valves 16 for feeding the high-pressure fuel to the engine 3. FIG. 1 shows moreover in schematic form a cam shaft 15 which imparts the reciprocating movement inside the cylinders 9 to the pistons 8. Along the intake duct 6, in particular between the low-pressure pump 4 and the intake valves 11, the pump unit comprises a metering valve 7. The operating principle of this valve 7 will emerge more clearly from the description of FIG. 2.

Figure 2:
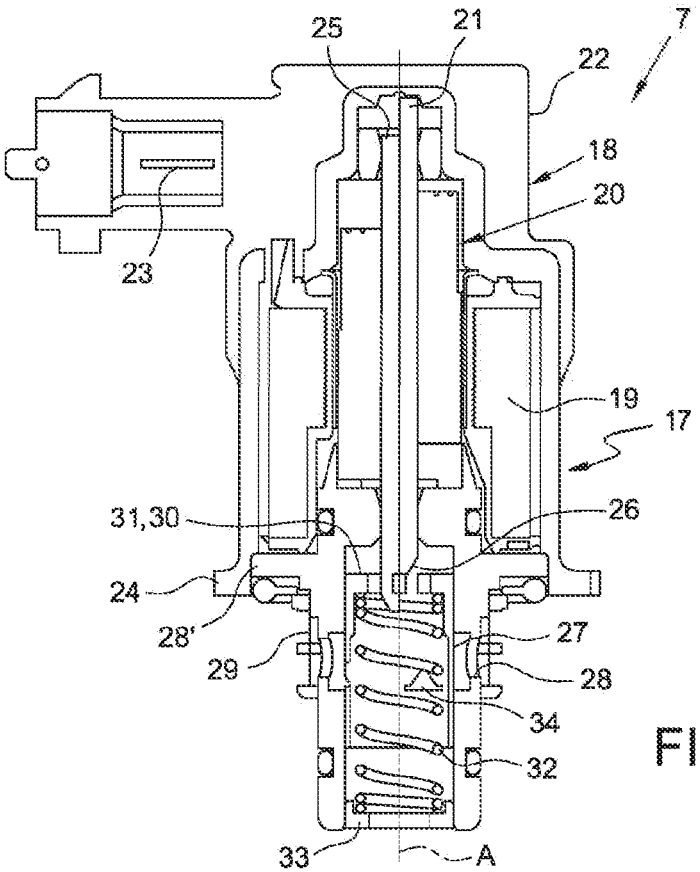
FIG. 2 is a schematic cross-sectional view of an example of a metering valve arranged along the circuit shown in FIG. 1 between the low-pressure pump and the high-pressure pump.
Figure 3:
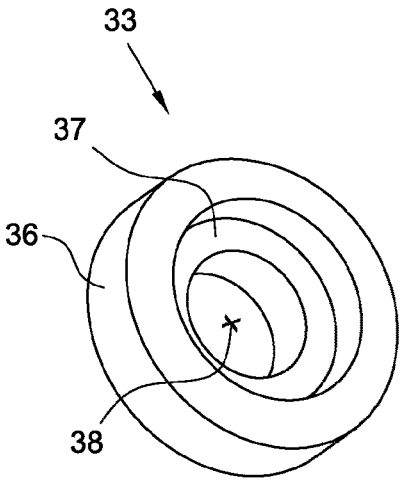
FIGS. 3 and 4 show, respectively, a retaining plug according to the prior art for the valve shown in FIG. 2 and engagement thereof inside said valve.
Figure 4:
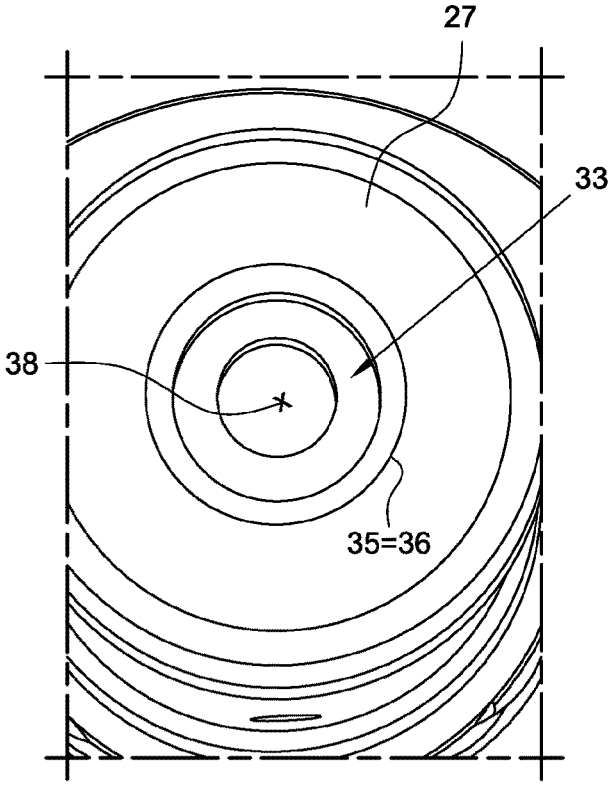

In accordance with that shown schematically in FIG. 2, the metering unit 2 is an electric valve, with at least one inlet side which communicates with the delivery of the low-pressure pump and at least one outlet side which communicates with the intake duct for feeding the intake chamber.

The metering unit 7 is flanged on a support body 17 which normally forms part of the high-pressure pump body and comprises an electromagnetic head 18. This electromagnetic head 18 comprises a coil 19 having an axis A inside which a core 20 made of magnetizable material is formed. The core 20 is mounted in an axially slidable manner along the axis A and comprises a thruster 21 coaxial with the axis A. The electromagnetic head 18 comprises furthermore a cup-shaped piece 22 which supports an electrical connector 23 for supplying current to the coil 19. This cup-shaped piece 22 houses a first end 25 of the thruster 21 and is provided with a flange 24 for connecting the valve 7 to the support body 17. The opposite end 26 of the thruster 21 penetrates inside a sleeve 27 which is coaxial with the axis A and is provided with a flange 28' which extends radially inwards, from the flange 24 of the cup-shaped piece 22, so that the sleeve 27 is locked by the cup-shaped piece 22 against the support body 17. As shown, the sleeve 27 penetrates at least partially inside the support 17. This portion of the sleeve 27 inside the support body 17 is provided with side openings 28 fed with the fuel delivered by the low-pressure pump 4. Special filters 29 are provided opposite these side openings 28. A piston 30 sliding along the axis A is housed inside the sleeve 27. This piston 30 is plug-shaped, namely comprises a cylindrical body with a closed end or top 31 and an open opposite end. The outer surface of the top 31 is pressed in a spring-loaded manner against the thruster 21. As shown in fact, a spring 32 is housed, partly inside the piston having a first end making bearing contact against the inner surface of the piston 30 and a second end bearing against a retaining plug 33 fastened inside the axial discharge opening 35 of the sleeve 27 in a position facing the open end of the piston 30. When current is supplied to the coils 19 a magnetic force is generated and this acts on the thruster 21 so as to overcome the force of the spring 32 and therefore cause displacement of the piston 30 relative to the sleeve 27. The movable piston 30 comprises side windows 34 (only partially visible in FIG. 2) which, during the piston stroke, are selectively arranged opposite the side openings 28 of the sleeve 27. In these conditions the fuel first passes beyond the openings 28 of the sleeve 27 and the windows 34 of the piston 30 and is then discharged via the open end of the piston 30. The particular profile of the windows 34 of the piston 30 is designed such that the fuel flow passing during the downward movement of the said piston 30 is proportional.

FIGS. 3 and 4 and FIGS. 5 and 6 show respectively a retaining plug according to the prior art and according to the invention and the associated connections with the discharge opening 35 of the sleeve 27.

As is known, the retaining plug 33 of the spring 32 has a cylindrical shape and comprises a side wall 36 so as to engage with the discharge opening 35 of the sleeve 27 and comprises in the surface facing the piston 30 a circumferential step 37 centred on the axis A for stably seating the spring 32. In order to allow discharging of the fuel, the retaining plug 33 comprises a through-hole 38 centred on the axis A and having a radius smaller than the step 37. According to the prior art schematically shown in FIGS. 3 and 4, when the plug 33 is inserted inside the discharge opening 35 of the sleeve 27 the side wall 36 is in contact over its entire length with the discharge opening 35 of the sleeve. In this condition the fuel may pass exclusively via the through-hole 38.

Figure 5:
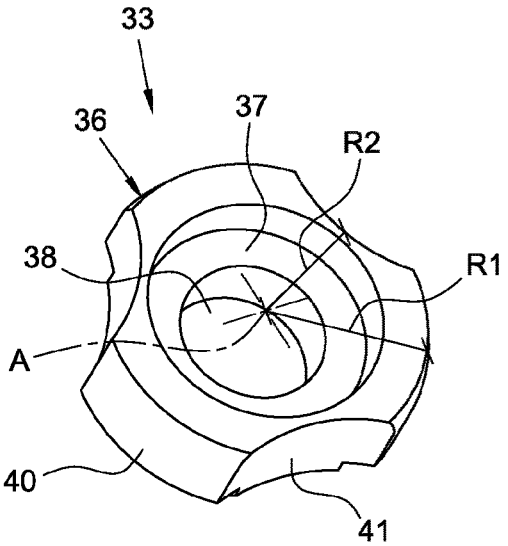
FIGS. 5 and 6 show, respectively, a retaining plug according to the invention for the valve shown in FIG. 2 and engagement thereof inside said valve.
Figure 6:
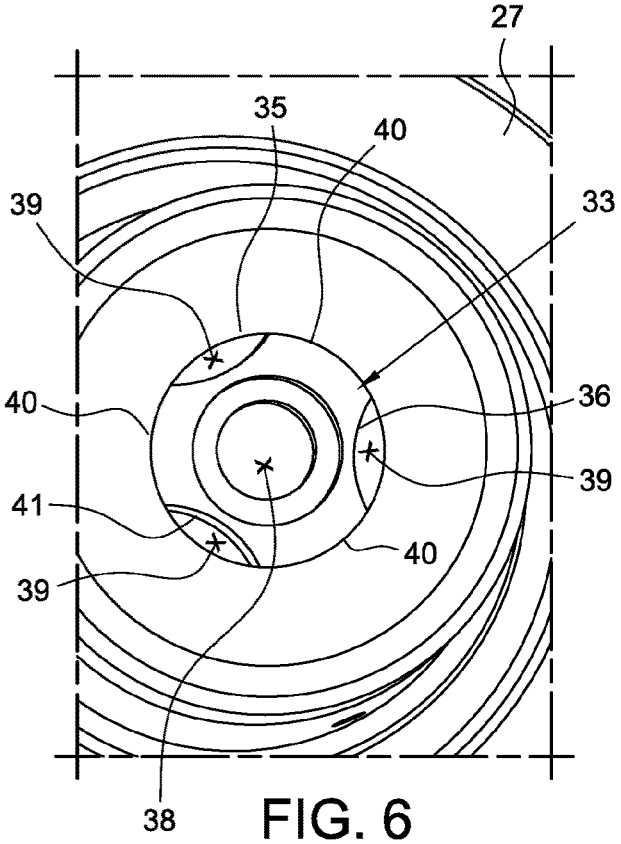

FIGS. 5 and 6 show how, according to the present invention, it is possible to increase the flow passing via the discharge opening 35, without modifying this discharge opening 35 nor the dimensions of the through-hole 38.

According to the present invention the side wall 36 is shaped so as to identify a portions 40 making contact with the discharge opening 35 and at least one side opening 39 between the side wall 36 and the discharge opening 35. This side opening 39 is in fact defined by an inset portion 41 having a radius R2 relative to the axis A smaller than the radius R1 of portion 40 making contact with the discharge opening 35. In the example shown three side openings 39 are present, these being formed in the region of three inset portions 41, so as to ensure an axial symmetry able to absorb uniformly the load of the spring 32. The minimum radius of these inset portions 41, which forms the maximum opening 39, coincides with the outer radius of the step 37.

It is clear that the present invention described here may be subject to modifications and variations without departing from the scope of the accompanying claims.

What is claimed is:

1. A metering valve (7) for a pump unit (1) for feeding fuel from a tank (2) to an internal combustion engine (3); the metering valve (7) comprising:

a sleeve (27) having an axis (A) and provided with a first open end for receiving a thruster (21), a second opposite end provided with an opening (35) for axially discharging the fuel and at least one side opening (28) for feeding fuel;

a plug-shaped piston (30) slidably housed along the axis A inside the sleeve (27), the piston (30) having a closed end (31) with an outer surface in contact with the thruster (21), an open opposite end and at least one side opening (34);

a plug (33) housed inside the discharge opening (35) of the sleeve and provided with an axial opening (38); and a spring (32) arranged between the plug (33) and the inner surface of the closed end (31) of the sleeve;

wherein the plug (33) is shaped so that, when housed inside the axial discharge opening (35), at least one lateral flow channel (39) for discharging the fuel is present, wherein the piston (30) has at least one side opening (34) cooperating with the side opening (28) of the sleeve (27) so that, selectively, fuel passes through the side opening (28) of the sleeve (27) and the side opening (34) of the piston (30) and is discharged via the open end of the piston (30), and wherein the plug (33) is provided with an axial through-hole (38) centered on the axis (A).

2. The valve as claimed in claim 1, wherein the plug (33) is shaped so that, when housed inside the axial discharge opening (35) of the sleeve (27), a plurality of lateral flow channels (39) for discharging fuel are present.

3. The valve as claimed in claim 2, wherein the lateral flow channels (39) are axially symmetrical with respect to the axis (A).

4. The valve as claimed in claim 1, wherein the plug (33) comprises an inner face provided with an axial step (37) for seating the spring (32).

5. The valve as claimed in claim 4, wherein the plug (33) comprises a side wall (36) having at least one portion for contact with the axial discharge opening (35) of the sleeve (27) and at least one inset portion (41) having a radius (R2) from the axis (A) smaller than the radius (R1) of the contact portion.

6. The valve as claimed in claim 5, wherein the radius (R2) of the inset portion (41) coincides with the outer radius of the axial step (37).

7. The valve as claimed in claim 1, further comprising a device for electromagnetically actuating the thruster (21).

8. A pump unit (1) for feeding fuel from a tank (2) to an internal combustion engine (3); the pump unit (1) comprising:

a low-pressure pump (4) for drawing fuel from the tank (2);

a high-pressure pump (5) fed by the low-pressure pump (4) for delivering high-pressure fuel to the engine (3), the high-pressure pump (5) comprising at least one intake valve (11) for feeding fuel into at least one cylinder (9) for housing a pumping piston (8) movable with a reciprocating motion between an intake stroke and a compression stroke;

an intake duct (6) which connects the low-pressure pump (4) to the high-pressure pump (5); and a valve (7) according to claim 1, the valve being arranged along the intake duct (6) for controlling the fuel fed to the intake valve (11) by the low-pressure pump (4).

9. A plug (33) for a metering valve (7) of a pump unit (1) for feeding fuel from a tank (2) to an internal combustion engine (3); wherein the metering valve (7) comprises:

a sleeve (27) having an axis (A) and provided with a first open end for receiving a thruster (21), a second opposite end provided with an opening (35) for axially discharging the fuel and at least one side opening (28) for feeding fuel; and a plug-shaped piston (30) slidably housed along the axis (A) inside the sleeve (27), the piston (30) having a closed end (31) with an outer surface in contact with the thruster (21), an open opposite end and at least one side opening (34);

wherein the plug (33) is shaped so as to be stably housed inside the discharge opening (35) of the sleeve and provided with an axial opening (38); and wherein the plug (33) is shaped so that, when the plug is housed inside the axial discharge opening (35), at least one lateral flow channel (39) for discharging fuel is present wherein the piston (30) has at least one side opening (34) cooperating with the side opening (28) of the sleeve (27) so that, selectively, fuel passes through the side opening (28) of the sleeve (27) and the side opening (34) of the piston (30) and is discharged via the open end of the piston (30), and wherein the plug (33) is provided with an axial through-hole (38) centered on the axis (A).

10. A method for increasing the flowrate of a metering valve (7) of a pump unit (1) for feeding fuel from a tank (2) to an internal combustion engine (3) without modifying the dimensions and the possibility of standardization of the components, the method comprising the steps of:

a) providing a valve (7) comprising a sleeve (27) having an axis (A) and provided with a first open end for receiving a thruster (21), a second opposite end provided with an opening (35) for axially discharging the fuel and at least one side opening (28) for feeding fuel; a plug-shaped piston (30) slidably housed along the axis (A) inside the sleeve (27), the piston (30) having a closed end (31) with an outer surface in contact with the thruster (21), an open opposite end and at least one side opening (34); a plug (33) housed inside the discharge opening (35) of the sleeve and provided with an axial opening (38); a spring (32) arranged between the plug (33) and the inner surface of the closed end (31) of the sleeve; the piston (30) having at least one side opening (34) cooperating with the side opening (28) of the sleeve (27) so that, selectively, fuel passes through the side opening (28) of the sleeve (27) and the side opening (34) of the piston (30) and is discharged via the open end of the piston (30); and wherein the plug (33) is provided with an axial through-hole (38) centered on the axis (A); and b) providing the plug (33) with a shape so that, when the plug is housed inside the axial discharge opening (35), at least one lateral flow channel (39) for discharging the fuel is present.

* * * * *